US008254808B2

(12) United States Patent
Lee et al.

(10) Patent No.: US 8,254,808 B2
(45) Date of Patent: Aug. 28, 2012

(54) IMAGE FORMING APPARATUS AND TRANSFER DEVICE THEREOF

(75) Inventors: Jun Ho Lee, Seoul (KR); Jeong Yong Ju, Suwon-Si (KR); Byeong Hwa Ahn, Seongnam-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 507 days.

(21) Appl. No.: 12/481,921

(22) Filed: Jun. 10, 2009

(65) Prior Publication Data

US 2009/0317150 A1 Dec. 24, 2009

(30) Foreign Application Priority Data

Jun. 20, 2008 (KR) ..... 10-2008-0058378

(51) Int. Cl.
*G03G 15/14* (2006.01)
*G03G 15/16* (2006.01)

(52) U.S. Cl. ..... 399/121; 399/302; 399/308

(58) Field of Classification Search ..... 399/116, 399/121, 298, 299, 302, 308
See application file for complete search history.

(56) References Cited

U.S. PATENT DOCUMENTS 6,061,542 A * 5/2000 Minami et al. ..... 399/299
6,134,402 A * 10/2000 Nakayama et al. ..... 399/101
6,249,662 B1 * 6/2001 Lee ..... 399/165
6,477,349 B2 * 11/2002 Kanekura et al. ..... 399/302
7,505,712 B2 * 3/2009 Kaiho ..... 399/121
7,650,099 B2 * 1/2010 Yano et al. ..... 399/165
7,957,673 B2 * 6/2011 Geyling et al. ..... 399/121

FOREIGN PATENT DOCUMENTS

JP 11344881 A * 12/1999
JP 2001022188 A * 1/2001
JP 2005115075 A * 4/2005
JP 2005292480 A * 10/2005
KR 10-2007-0036874 4/2007

OTHER PUBLICATIONS

English abstract of KR-10-2007-0036874.

* cited by examiner

*Primary Examiner* — David Gray
*Assistant Examiner* — Fred L Braun
(74) *Attorney, Agent, or Firm* — Stanzione & Kim, LLP

(57) ABSTRACT

An image forming apparatus and a transfer device thereof the transfer device including an intermediate transfer belt, at least one intermediate transfer belt roller to maintain tension in the intermediate transfer belt, transfer rollers to press the intermediate transfer belt to image carriers and a state changing device. The state changing device includes: a rotating shaft; a first cam member coupled to the rotating shaft and configured to move the intermediate transfer belt roller to reduce the tension applied to the intermediate transfer belt; and a second cam member coupled to the rotating shaft and configured to move at least one of the transfer rollers away from the intermediate transfer belt.

13 Claims, 9 Drawing Sheets

IMAGE FORMING APPARATUS AND TRANSFER DEVICE THEREOF

CROSS-REFERENCE TO RELATED APPLICATION

This application claims the benefit under 35 U.S.C. §120 of Korean Patent Application No. 10-2008-0058378, filed on Jun. 20, 2008 in the Korean Intellectual Property Office, the entire disclosure of which is incorporated herein by reference.

TECHNICAL FIELD

The present invention relates to an image forming apparatus, and more particularly, to an image forming apparatus with improved space utilization and a reduced overall size.

BACKGROUND OF RELATED ART

An image forming apparatus refers to an apparatus that prints an image on a printing medium, e.g., paper, according to an input image signal. An image forming apparatus may generally be classified as a printer, a copying machine, a fax machine, a multi-function printer, which includes multiple functions of printing, scanning, copying and/or faxing, and the like.

An electrophotographic type image forming apparatus generally includes an exposure device, a transfer device, a developing device, a fusing device and a main body, which defines a general exterior appearance of the image forming apparatus, and which accommodate one or more of the above components.

A printing medium, carrying on the surface thereof a quantity of developer forming the image, is subjected to a high temperature and/or high pressure while passing through a fusing device, so that the developer image is fused to the printing medium.

A transfer device transfers a visible developer image formed on an image carrier to a printing medium, in some cases by first transferring the image to an intermediate transfer body, from which the developer image is re-transferred to the printing medium.

However, a conventional image forming apparatus employing an intermediate transfer belt as the intermediate transfer body is configured such that even when it is in a non-operating state, i.e., in a stand-by state, the intermediate transfer belt may still be in the stretched state retaining a certain level of tensile force, which may result in shortening the life of the intermediate transfer belt.

Also, even When a black and white image is being printed with a conventional image forming apparatus, not only the image carrier for the black color, which is involved in the image transfer, but also those image carriers of other colors, which are not involved in the image transfer operation, are nevertheless also in contact with the intermediate transfer body. Such unnecessary contacts between the intermediate transfer body and the image carriers may contribute to the shortening of the life of the intermediate transfer body.

It would therefore be desirable to provide in an image forming apparatus the feature(s) of controlling the tension of the intermediate transfer body and/or the contacts between the image carriers and the intermediate transfer body, and more preferably that such feature(s) are provided in a manner allowing efficient space utilization.

SUMMARY OF THE DISCLOSURE

In accordance with an aspect of the invention, there is provided a transfer device, which may comprise an intermediate transfer belt; at least one intermediate transfer belt roller configured to provide tension in the intermediate transfer belt; one or more transfer rollers each configured to press the intermediate transfer belt toward respective corresponding one of one or more image carriers; and a state changing device configured to change an operating state of the transfer device into at least one of a first state, in which the tension in the intermediate transfer belt is released, and a second state, in which select ones of the one or more transfer rollers are separated from the intermediate transfer belt.

The state changing device may include a tension release device configured to release the tension in the intermediate transfer belt; and a contact release device configured to prevent select ones of the one or more image carriers from contacting the intermediate transfer belt.

The at least one intermediate transfer belt roller may include a plurality of intermediate transfer belt rollers. The tension release device may be configured to change a position of at least one of the plurality of intermediate transfer belt rollers between a first belt roller position and a second belt roller position. The at least one of the plurality of intermediate transfer belt roller may exert less amount of pressing force against the intermediate transfer belt when the at least one of the plurality of intermediate transfer belt roller is in the second belt roller position than when the at least one of the plurality of intermediate transfer belt roller is in the first belt roller position.

The tension release device may include a rotating shaft; a first cam member coupled to the rotating shaft; and a lever arranged to pivot in association with an eccentric rotation of the first cam member about the rotating shaft. The lever may be configured to cause the position of at least one of the plurality of intermediate transfer belt rollers between the first belt roller position and the second belt roller position according to the direction of pivot of the lever.

The contact release device may be configured to change the position of the select ones of the one or more transfer rollers from a first transfer roller position and a second transfer roller position. The select ones of the one or more transfer rollers may be in contact with the intermediate transfer belt when in the first transfer roller position. The select ones of the one or more transfer rollers may be separated from the intermediate transfer belt when in the second transfer roller position.

The contact release device may include a rotating shaft; a second cam member coupled to the rotating shaft; and a transfer roller receiving part to support thereon the select ones of the one or more transfer rollers. The transfer roller receiving part may be configured to pivot, in association with an eccentric rotation of the second cam member, in a direction of moving the select ones of the one or more transfer rollers away from the intermediate transfer belt.

The operating state may include a first operating mode, in which the at least one intermediate transfer belt roller is in contact with the intermediate transfer belt so as to maintain the tension in the intermediate transfer belt; a second operating mode, in which the at least one intermediate transfer belt roller is separated from the intermediate transfer belt so as to release the tension in the intermediate transfer belt; a third operating mode, in which each of the one or more transfer rollers presses the intermediate transfer belt toward the respective corresponding one of the one or more image carriers so as to cause each of the one or more image carriers to be in contact with the intermediate transfer belt; and a fourth operating mode, in which the select ones of the one or more transfer rollers are separated from the intermediate transfer belt so as to cause the intermediate transfer belt to be separated from respective ones of the one or more image carriers corresponding to the select ones of the one or more transfer rollers.

The state changing device may further include a sensing unit to sense a current operating state.

The sensing unit may include a rotating shaft; a sensed part coupled to the rotating shaft, the sensed part having at least one position determination portion; and a sensing part configured to sense the position determination portion during a rotation of the sensed part about the rotating shaft, sensing part being further configured to generate a control signal upon sensing of the position determination portion.

The rotating shaft may be rotated further by an amount of rotational angle after the sensing part generating the control signal, the amount of rotational angle being based on a time duration during which the rotating shaft is driven in relation to the control signal.

According to another aspect, a transfer device may comprise an intermediate transfer belt arranged to be in contact with one or more of a plurality of image carriers; and a state changing device, which may include at least one cam member, the state changing device being configured to change, based on a rotation of the at least one cam member, an operating mode of the transfer device between at least one of a tension release mode, in which a tension in the intermediate transfer belt is released, and a contact release mode, in which the intermediate transfer belt is separated from a select subset of the plurality of image carriers.

The state changing device may include a rotating shaft coupled to the cam member, the rotating shaft providing a rotating force to the cam member; and a sensing unit to sense a rotational position of the rotating shaft.

According to yet another aspect, an image forming apparatus may be provided to include a main body; a plurality of image carriers supported in the main body; an intermediate transfer belt arranged to contact one or more of the plurality of image carriers; a plurality of transfer rollers each configured to press the intermediate transfer belt toward a respective corresponding one of the plurality of image carriers; a plurality of intermediate transfer belt rollers configured to support the intermediate transfer belt so as to cause the intermediate transfer belt to exhibit a level of tension therein; and a state changing device to change the operating state of the image forming apparatus between at least one of a first operating state, in which the tension in the intermediate transfer belt is released, and a second operating state, in which select ones of the plurality of transfer rollers are moved away and spaced apart from the intermediate transfer belt, the state changing device affecting the change in the operating state by changing positions of at least one of one or more of the plurality of transfer rollers and one or more of the plurality of intermediate transfer belt rollers.

The state changing device may include a tension release device configured to separate at least one of the plurality of intermediate transfer belt rollers from the intermediate transfer belt so as to release the tension in the intermediate transfer belt; and a contact release device to separate at least one of the plurality of transfer rollers from the intermediate transfer belt.

The state changing device may include a rotating shaft; a first cam member coupled to the rotating shaft; a second cam member coupled to the rotating shaft; a lever configured to pivot in association with an eccentric rotation of the first cam member about the rotating shaft to cause at least one of the plurality of intermediate transfer belt rollers to become separated from the intermediate transfer belt; and a transfer roller receiving part to support thereon at least one of the plurality of transfer rollers, the transfer roller receiving part being configured to, in association with an eccentric rotation of the second cam member, pivot in a direction of separating the at least one of the plurality of transfer roller supported on the transfer roller receiving part away from a respective corresponding associated one of the plurality of image carriers.

The state changing device may include a sensed part coupled to the rotating shaft, the sensed part having at least one position determination portion; and a sensing part to sense the position determination portion as the sensed part rotates about the rotating shaft, the sensing part being further configured to output a control signal upon sensing of the position determination portion.

According to even yet another aspect, an apparatus for controlling a transfer device of an image forming apparatus may be provided. The image forming apparatus may be operable in at least first and second operational modes. The transfer device may include an intermediate transfer belt for receiving developer images from one or more image carriers and one or more transfer rollers each configured to impart pressing force on the intermediate transfer belt so as to maintain a contact between the intermediate transfer belt and a respective corresponding one of the one or more image carriers. The transfer device may further include one or more intermediate transfer belt rollers configured to cause the intermediate transfer belt to rotate while having an operational level of tension therein. The apparatus for controlling the transfer device may comprise a rotating shaft; and a first cam member coupled to the rotating shaft so as to rotate with and about the rotating shaft, the rotating shaft having a first rotational position corresponding to the first operational mode of the image forming apparatus and a second rotational position corresponding to the second operational mode of the image forming apparatus. When the rotating shaft is in the first rotational position, the first cam member may cause at least one of the one or more intermediate transfer belt rollers to move away from the intermediate transfer belt such that the intermediate transfer belt has a relaxed level of tension that is less than the operational level of tension. When the rotating shaft is in the second rotational position, the operational level of tension may be maintained in the intermediate transfer belt.

The control apparatus may further comprise a second cam member coupled to the rotating shaft so as to rotate with and about the rotating shaft. The second cam member, when the rotating shaft is in the second rotational position, may cause at least one of the one or more transfer rollers to move away from the intermediate transfer belt such that the intermediate transfer belt and the respective one of the one or more image carriers corresponding to the at least one of the one or more transfer rollers are spaced apart from each other.

The control apparatus may further comprise an intermediate transfer belt roller support member supporting thereon the at least one of the one or more intermediate transfer belt rollers and a lever configured to pivot between a first lever position and a second lever position. The intermediate transfer belt roller support member may have formed fixedly thereon a locking protrusion. When the rotating shaft is in the first rotational position, the lever may be in the first lever position, at which position a first end of the lever being in interfering contact with first cam member while a second end of the lever opposite the first end being in pressing contact with, and exerting a sufficient pressing force on, the locking protrusion so as to cause the intermediate transfer belt roller support member to move. When the rotating shaft is in the second rotational position, the lever may be in the second lever position in which position the lever exerts no pressing force on the locking protrusion.

The control apparatus may further comprise a transfer roller support member configured support thereon the at least one of the one or more transfer rollers. When the rotating shaft is in the second rotational position, the second cam member may be in pressing contact with the transfer roller support member so as to cause the transfer roller support member to pivot away from the intermediate transfer belt.

BRIEF DESCRIPTION OF THE DRAWINGS

Various aspects and/or advantages of the embodiments of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
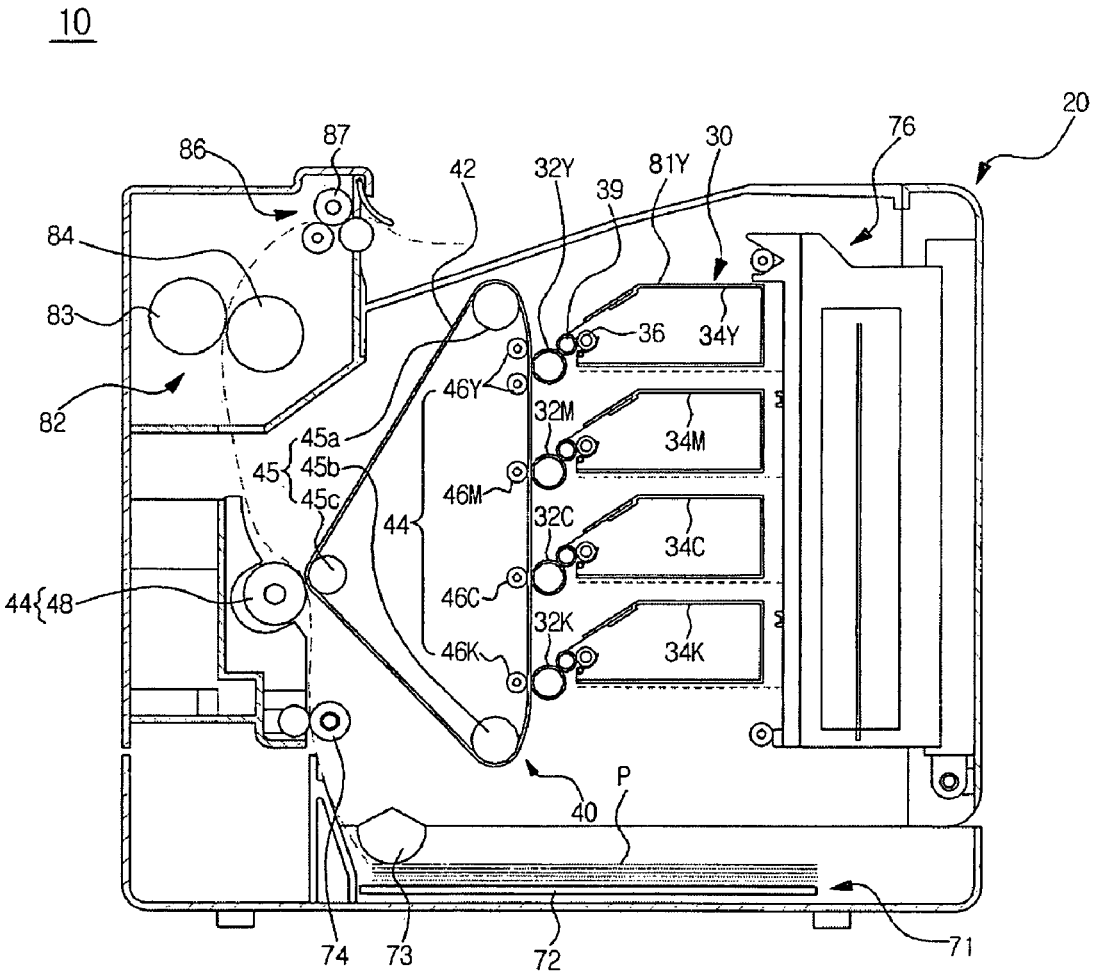
FIG. 1 is a sectional view showing an image forming apparatus according to an embodiment of the present disclosure.

Several embodiments will now be described more fully with reference to the accompanying drawings, in which like reference numerals refer to like elements throughout.

FIG. 1 is a sectional view showing an image forming apparatus according to an embodiment of the present disclosure. As depicted, an image forming apparatus 10 according to an embodiment may comprise a printing medium feeding device 71, a laser scanning device 76, a developing device 30, a transfer device 40, a fusing device 82, a printing medium discharge device 86 and a main body 20, which may accommodate therein one or more of the above components.

The printing medium feeding device 71 may include a tray 72 to load one or more printing media P thereon and a pickup roller 73 to pick up the printing medium P loaded on the tray 72 sheet by sheet. The printing medium P picked up by the pickup roller 73 may be conveyed to the transfer device 40 by a feeding roller 74.

The laser scanning device 76 serves to scan light to the image carriers 32Y, 32M, 32C and 32K of the developing device 30 before the printing medium P advances to the transfer device 40. According to an embodiment, the image carriers 32Y, 32M, 32C and 32K may be provided to respectively correspond to developing assemblies 34Y, 34M, 34C and 34K storing developer of different colors from each other, e.g., yellow (Y), magenta (M), cyan (C) and black (K), respectively. The developing assemblies 34Y, 34M, 34C and 34K, for example, in the depicted tandem type embodiment, may be arranged parallel to each other along the vertical direction. However, the number and arrangement of the image carriers 32Y, 32M, 32C and 32K and the developing assemblies 34Y, 34M, 34C and 34K are not limited to that depicted in FIG. 1. Electrostatic latent images may be formed on the surfaces of the image carriers 32Y, 32M, 32C and 32K by the light L from the laser scanning device 76 being incident thereupon. The image carriers 32Y, 32M, 32C and 32K may be configured as a photosensitive body, for example. The developing assemblies 34Y, 34M, 34C and 34K may each include a supply roller 36 and a developing roller 39 to supply developer to, and to thereby develop the electrostatic latent images of, respective one of the image carriers 32Y, 32M, 32C and 32K.

The fusing device 82 may includes a heating roller 83 and a press roller 84. The printing medium P, to which an image has been transferred, passes through the transfer device 40 between the heating roller 83 and the press roller 84. The heating roller 83 and the press roller 84 apply pressure and/or heat to the printing medium P, so as to fuse the developer on the surface of the printing medium P to the printing medium P.

The printing medium discharge device 86 may includes a discharge roller 87. The printing medium P having passed through the fusing device 82 is discharged outside the image forming apparatus 10 by the discharge roller 87.

The transfer device 40 receives developer images in an overlapping manner from the image carriers 32Y, 32M, 32C and 32K, and transfers a color image to the printing medium P. According to an embodiment, electrostatic latent images may be formed on the surfaces of the image carriers 32Y, 32M, 32C and 32K by being exposed to the light from the laser scanning device 76. The developer of respective color is supplied to the corresponding electrostatic latent image to form a visible image of the respective color on each of image carriers 32Y, 32M, 32C. The image carriers 32Y, 32M, 32C and 32K rotate in contact with the intermediate transfer belt 42 to each transfer the respective visible image to the intermediate transfer belt 42, the individual visible images overlapping with one another to form a full color image. The intermediate transfer belt 42, on which the color image is formed, re-transfers the image onto the printing medium P, so that the image is formed on the printing medium P. The transfer process of the intermediate transfer belt 42 is carried out by intermediate transfer belt rollers 45 and transfer rollers 44 maintaining a tension of the intermediate transfer belt 42.

The intermediate transfer belt rollers 45 are in contact with the intermediate transfer belt 42, so that the intermediate transfer belt 42 has a predetermined tension. According to an embodiment, three intermediate transfer belt rollers 45 may be provided in contact with three locations along the intermediate transfer belt, However, the number of the intermediate transfer belt rollers 45 is not limited to three. According to the embodiment shown in FIG. 1, the intermediate transfer belt rollers 45 may include a first intermediate transfer belt roller 45*a*, a second intermediate transfer belt roller 45*b* and a third intermediate transfer belt roller 45*c*. The first to third intermediate transfer belt rollers 45*a*, 45*b* and 45*c* may be in contact with an inner surface of the intermediate transfer belt 42 so as to keep the intermediate transfer belt 42 taut with a certain tension.

If, however, the intermediate transfer belt 42 is kept in the stretched state in contact with the intermediate transfer belt rollers 45 over a prolonged period of time, deformation of the intermediate transfer belt 42 may occur. For example, when the image forming apparatus remains in an idle state, the intermediate transfer belt 42 may remain stationary. If the non-rotating intermediate transfer belt 42 is nevertheless kept under tension and in pressing contact with the intermediate transfer belt rollers 45, the portions of the intermediate transfer belt 42 in contacted with the intermediate transfer belt rollers 45 receive stress substantially in conformance with the shapes of the intermediate transfer belt rollers 45. If the image forming apparatus 10 remains idle for a prolonged time, it may result in permanent deformation of the intermediate transfer belt 42. In order to mitigate the aforementioned problem, the image forming apparatus 10 according to an embodiment of the present disclosure may be provided with a state changing device 50 (refer to FIG. 2), which will be explained in greater detail later.

The transfer rollers 44 may include first transfer rollers 46Y, 46M, 46C and 46K to press the intermediate transfer belt 42 toward the image carriers 32Y, 32M, 32C and 32K, and a second transfer roller 48 disposed to oppose the third intermediate transfer belt roller 45*c* with the intermediate transfer belt 42 interposed therebetween. The first transfer rollers 46Y, 46M, 46C and 46K press the intermediate transfer belt 42 to the image carriers 32Y, 32M, 32C and 32K, respectively, so as to allow the visible images formed on the image carriers 32Y, 32M, 32C and 32K to be transferred to the intermediate transfer belt 42. The second transfer roller 48 presses the intermediate transfer belt 42 to the third intermediate transfer belt roller 45*c*, so that the image formed on the intermediate transfer belt 42 may in turn be transferred to the printing medium P.

The image forming apparatus 10 may operate not only in a color mode, in which the developers of all colors are used to form a color image, but also frequently operates in a monochromatic mode, in which only the developer of black is used to form a black and white image. In a case of monochromatic mode, only the black developing assembly 34K and the black image carrier 32K provided corresponding to the black developing assembly 34K may be involved in the printing process. However, because the intermediate transfer belt 42 is pressed to each of the image carriers 32Y, 32M, 32C and 32K by the first transfer rollers 46Y, 46M, 46C and 46K, respectively, when the intermediate transfer belt 42 rotates, the yellow, magenta and cyan image carriers 32Y, 32M and 32C, which may run idle, may still be in contact with the intermediate transfer belt 42, possibly shortening the useful life of the yellow, magenta and cyan image carriers 32Y, 32M and 32C and/or also possibly subjecting the intermediate transfer belt 42 to unnecessary wear due to the surface friction. The deterioration of the image carriers and/or the intermediate transfer belt 42 may in turn cause the printing quality to suffer. In order to mitigate such problems, the image forming apparatus 10 according to an embodiment may be provided a state changing device 50 (refer to FIG. 2), which will be explained in greater detail below.

Figure 2:
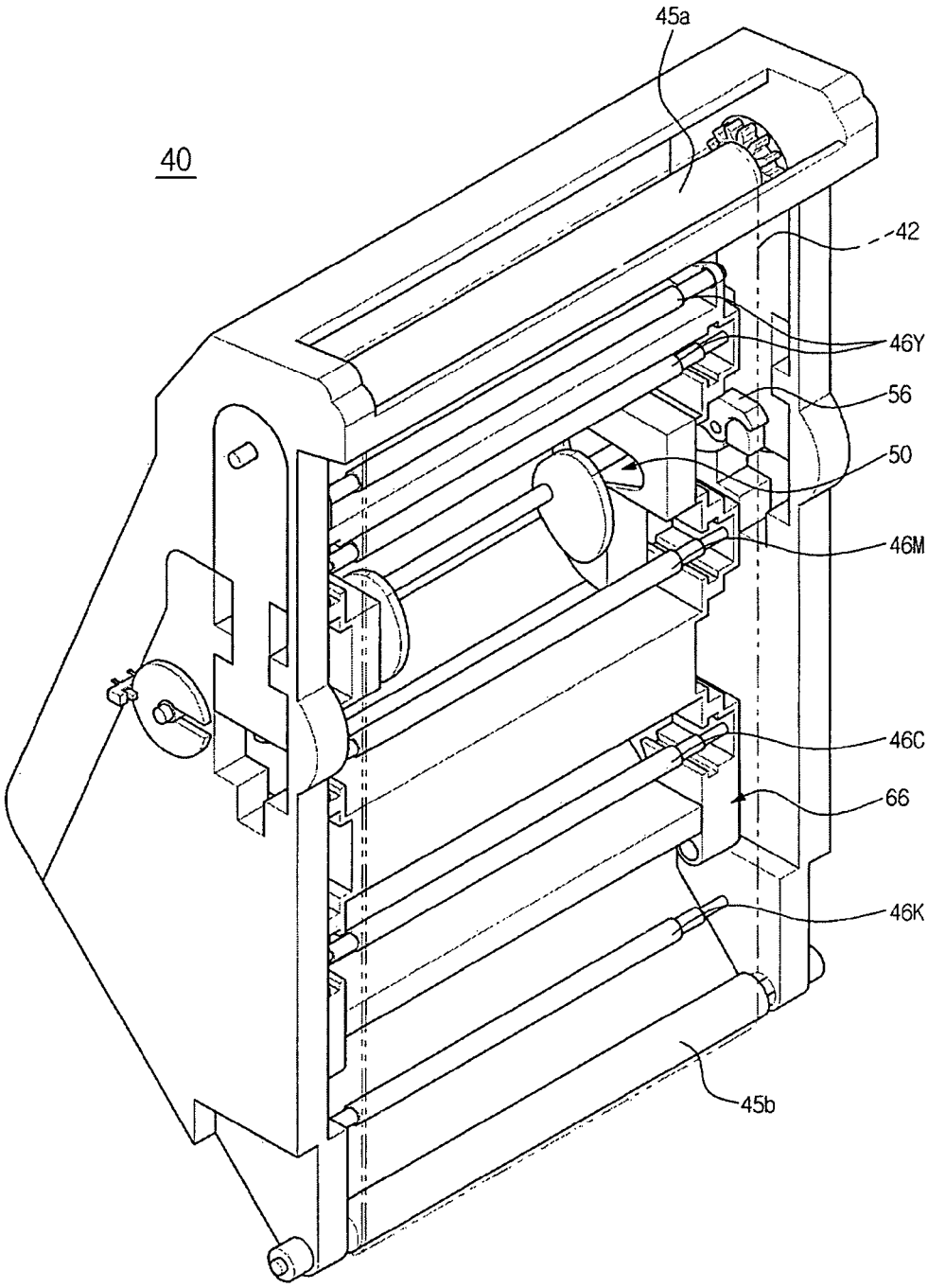
FIG. 2 is a perspective view of a transfer device depicted in FIG. 1.
Figure 3:
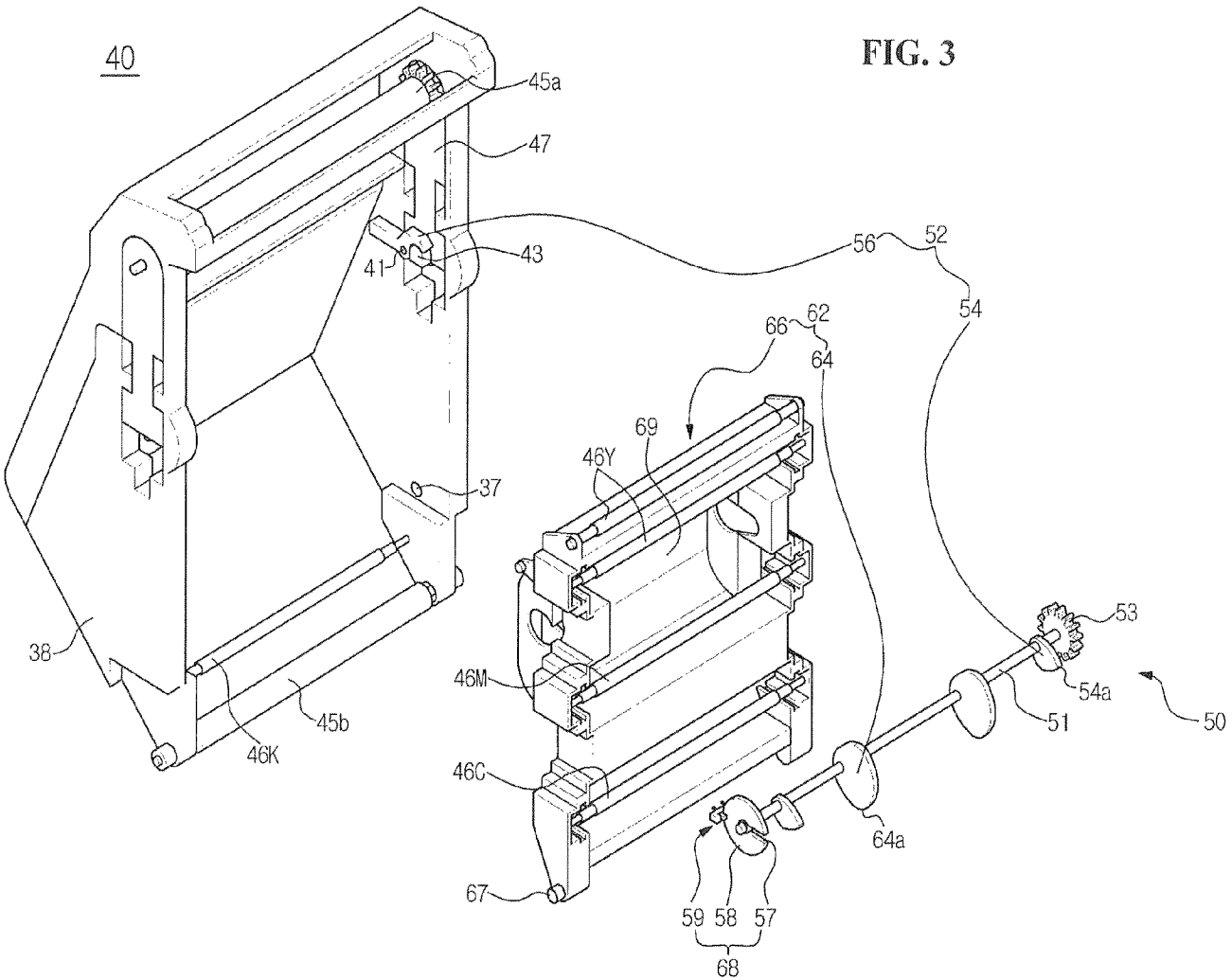
FIG. 3 is an exploded perspective view of the transfer device depicted in FIG. 2.

FIG. 2 is a perspective view of the transfer device depicted in FIG. 1, and FIG. 3 is an exploded perspective view of the transfer device depicted in FIG. 2.

As shown in the drawings, the state changing device 50 according to embodiments of the present disclosure may include one or more of a tension release device 52, a contact release device 62 and a sensing unit 68.

The state changing device 50 serves to switch operating modes by changing the relative state of the intermediate transfer belt 42. The image forming apparatus 10 is configured to operate in one or more of, for example, a stand-by mode, a color mode and a monochromatic mode. The stand-by mode refers to a mode in which the image forming apparatus 10 is in an idle state, i.e., not performing a printing operation, the color mode refers to a mode in which color printing is achieved, and the monochromatic mode refers to a mode in which black and white printing is achieved. The state changing device 50 may control the tensile force to be applied to the intermediate transfer belt 42 according to the respective operating modes. According to an embodiment, the state changing device 50 may also control the contact between the intermediate transfer belt 42 and one or more of the image carriers 32Y, 32M, 32C and 32K according to the operating modes. As will be further described, according to an embodiment, the state changing device 50 may be of a relatively simple structure that allows efficient space utilization and the reduction of the overall size of the image forming apparatus 10.

According to an embodiment, the tension release device 52 serves to move the first intermediate transfer belt roller 45*a* down to reduce the tension in the intermediate transfer belt 42. When the image forming apparatus 10 operates, the first to third intermediate transfer belt rollers 45*a*, 45*b* and 45*c* provided so as to contact the inner surface of the intermediate transfer belt 42, pressing the intermediate transfer belt 42 outwardly so that the intermediate transfer belt 42 is kept stretched or taut with certain tension. On the other hand, when the image forming apparatus 10 is in a non-operating state, i.e., in a stand-by mode, the tension release device 52 operates to move the first intermediate transfer belt roller 45*a* down. If the first intermediate transfer belt roller 45*a* is moved down, even though the second and third intermediate transfer belt rollers 45*b* and 45*c* stay at their positions, the tension of the intermediate transfer belt 42 is released, in which case, the pressing force of the first to third intermediate transfer belt rollers 45*a*, 45*b* and 45*c* on the intermediate transfer belt 42 is reduced, thereby reducing the possibility of the deformation of the intermediate transfer belt 42. The tension release device 52, according to an embodiment, may include a rotating shaft 51, a first cam member 54 coupled to the rotating shaft 51, and a lever 56 which may pivot up and down by the first cam member 54.

The rotating shaft 51 may be connected to a driving gear 53 which transmits driving power from a driving unit (not shown). The rotating shaft 51 may be controlled by control signal(s) supplied to the driving unit (not shown). The control signal(s) may be changed based on the operating mode of the image forming apparatus 10, e.g., the stand-by mode, the color mode and the monochromatic mode. The rotating shaft 51 is coupled with the first cam member 54.

The first cam member 54 is eccentrically rotated by the rotation of the rotating shaft 51. In the embodiment shown in FIG. 3, a pair of first cam members 54 are provided on the rotating shaft 51, however the number of the first cam members is not limited to two. The pair of first cam members 54 may have the same eccentricity orientation. That is, when the long axis end 54*a* of one of the pair of first cam members 54 is directed down, the long axis end of the other first cam member may be also directed down. Each of the first cam members 54 may be arranged with a corresponding lever 56, with which the respective first cam member comes in contacted during its rotation.

The lever 56 serves to move the first intermediate transfer belt roller 45*a* down. The first intermediate transfer belt roller 45*a* is connected to an extending part 47, and the extending part 47 is formed with a latching protrusion 43 at one of its end portions. For example, the lever 56 may be configured to pivot about the rotating shaft 41 such that one end of the lever 56 comes in contact with the latching protrusion 43 when the other end thereof comes in contact with, and is thereby pressed by, the first cam member 54. When, as the first cam member 54 rotates, the long axis end 54*a* thereof comes in contact with, and pushes up against one end of the lever 56, the other end of the lever 56 moves downward by the pivoting of the lever 56 about a rotating shaft 41 provided, e.g., at the middle portion of the lever 56, and pushes the latching protrusion 43 down. The downward movement of the latching protrusion 43 causes the first intermediate transfer belt roller

45*a* connected to the latching protrusion 43 (extending part 47) to also move downward, thereby reducing the tension applied to the intermediate transfer belt 42.

The contact release device 62 serves to rotate a transfer roller receiving part 66 to separate the intermediate transfer belt 42 from one or more of the image carriers 32Y, 32M, 32C and 32K. For example, according to an embodiment, when the image forming apparatus 10 is in the color mode to form a color image, the contact release device 62 may operate to allow the image carriers 32Y, 32M, 32C and 32K to contact the intermediate transfer belt 42. However, when the operating mode of the image forming apparatus 10 is the monochromatic mode to form a black and white image, the contact release device 62 operates to cause one or more of the yellow, magenta and cyan transfer rollers 46Y, 46M and 46C to be separated from the intermediate transfer belt 42. Accordingly, in the monochromatic mode, while the intermediate transfer belt 42 rotates, unnecessary contact between the intermediate transfer belt 42 is and the idling yellow, magenta and cyan image carriers 32Y, 32M and 32C may be avoided. As a result, the friction damages to the intermediate transfer belt 42 and the yellow, magenta and cyan image carriers 32Y, 32M and 32C may be reduced. According to an embodiment, the contact release device 62 may include the rotating shaft 51, a second cam member 64 coupled to the rotating shaft 51 and the transfer roller receiving part 66 which rotatably supports the yellow, magenta and cyan transfer rollers 46Y, 46M and 46C.

The second cam member 64 is eccentrically rotated about the rotating shaft 51. According to an embodiment, the extending direction of a long axis end 64*a* of the second cam member 64 may be different from the direction along which the long axis end 54*a* of the first cam member 54 extends. For example, when the long axis end 54*a* of the first cam member 54 is directed straight down during the rotation of the rotating shaft 51, the long axis end 64*a* of the second cam member 64 is not directed straight down. In the embodiment shown in FIG. 3, a pair of second cam members 64 are provided on the rotating shaft 51, however the number of the second cam members is not limited to two. Although the extending direction of the long axis end 54*a* of each of the first cam members 54 is different from the extending direction of the long axis end 64*a* of each of the second cam members 64, the pair of second cam members 64 according to an embodiment may have the same eccentric direction with respect to each other. If the rotating shaft 51 is rotated at a preset angle according to the control signal(s), the long axis ends 64*a* of the second cam members 64 come in contacted with the transfer roller receiving part 66, pressing the transfer roller receiving part 66 to rotate backward.

The transfer roller receiving part 66 receives one or more of the yellow, magenta and cyan transfer rollers 46Y, 46M and 46C. While, in the embodiment shown in FIG. 3, each of the yellow, magenta and cyan transfer rollers 46Y, 46M and 46C are supported by the transfer roller receiving part 66, alternative embodiments where lesser number of transfer rollers are supported in the transfer roller receiving part 66 may also be possible. The transfer roller receiving part 66 is formed with rotating shafts 67 at a lower end portion thereof, and the rotating shafts 67 are rotatably fitted in shaft holes 37 provided at a transfer device body 38. The transfer roller receiving part 66 has an inner contact surface 69. When, for example, the image forming apparatus 10 is in the monochromatic mode, the rotating shaft 51 is rotated according to the control signal(s) such that the long axis ends 64*a* of the second cam members 64 come in contact with the surface 69, and pushes the transfer roller receiving part 66 backward. As a result, the transfer roller receiving part 66 rotates about the rotating shafts 67, causing the yellow, magenta and cyan transfer rollers 46Y, 46M and 46C received in the transfer roller receiving part 66 to become separated from the intermediate transfer belt 42, reducing the likelihood of damages to the yellow, magenta and/or cyan image carriers 32Y, 32M and 32C, and/or to the intermediate transfer belt 42 due to unnecessary frictional contact between the image carriers and the intermediate transfer belt 42. Even when the transfer roller receiving part 66 is in the rotated backward position, the black transfer roller 46K, which is coupled to the transfer device body 38 separately from the transfer roller receiving part 66, may be kept in contact with the intermediate transfer belt 42. Accordingly, even when the transfer roller receiving part 66 is in the pushed back state, the printing of a black and white image using the black transfer roller 46K can still be carried out.

According to an embodiment, a sensing unit 68 may be provided at least one end portion of the rotating shaft 51. The relative position of the intermediate transfer belt 42 may be changed according to the color mode, the monochromatic mode and the stand-by mode. In the color mode, the intermediate transfer belt 42 may be in contact with the image carriers 32Y, 32M, 32C and 32K. In the monochromatic mode, the transfer roller receiving part 66 may be rotated so that the intermediate transfer belt 42 is in contact only with the black image carrier 32K. In the stand-by mode, the first intermediate transfer belt roller 45*a* may move down so as to reduce the tension in the intermediate transfer belt. The operating modes may be changed by the first and second cam members 54 and 64 contacting, or being separated from, specific portions of the transfer device 40. The positions of the first and second cam members 54 and 64 may be changed according to the rotational angle of the rotating shaft 51. The sensing unit 68 detects the current position of the rotating shaft 51, and provides information for determination relating to the target rotational angle of the rotating shaft 51 to switch the current operating mode into a desired mode. The sensing unit 68 may include a sensed part 58 and a yellowsensing part 59.

The sensed part 58 is coupled to the rotating shaft 51, and is rotated together with the rotation of the rotating shaft 51. The sensed part 58 is provided with a position determination portion 57. The position determination portion 57 is, according to an embodiment, configured as a slit provided at a reference position of the sensed part 58.

The sensing part 59 is disposed at a predetermined distance from the sensed part 58. The sensing part 59 may be configured as, for example, an optical sensor. The sensing part 59 senses the position determination portion 57 of the sensed part 58 which rotates. While the sensed part 58 rotates, the sensing part 59 senses the moment the position determination portion 57 passes by the sensing part 59, and based on the sensing of the position determination portion 57, determines the position of the state changing device 50 using the position of the position determination portion 57 as a reference position.

The operation of the tension release device and the contact release device configured according to the above described embodiments of the present disclosure will now be explained with reference to FIGS. 4 to 7.

Figure 4:
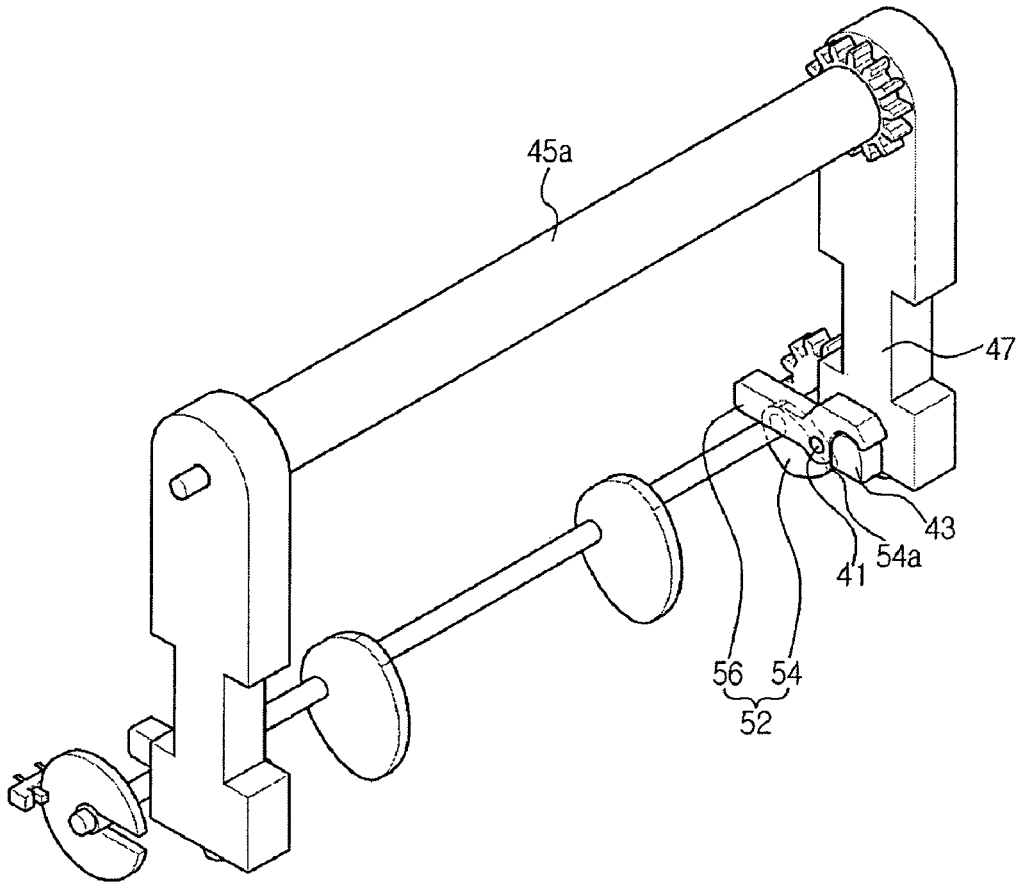
FIGS. 4 and 5 are views showing operation of a tension release device depicted in FIG. 2.
Figure 5:
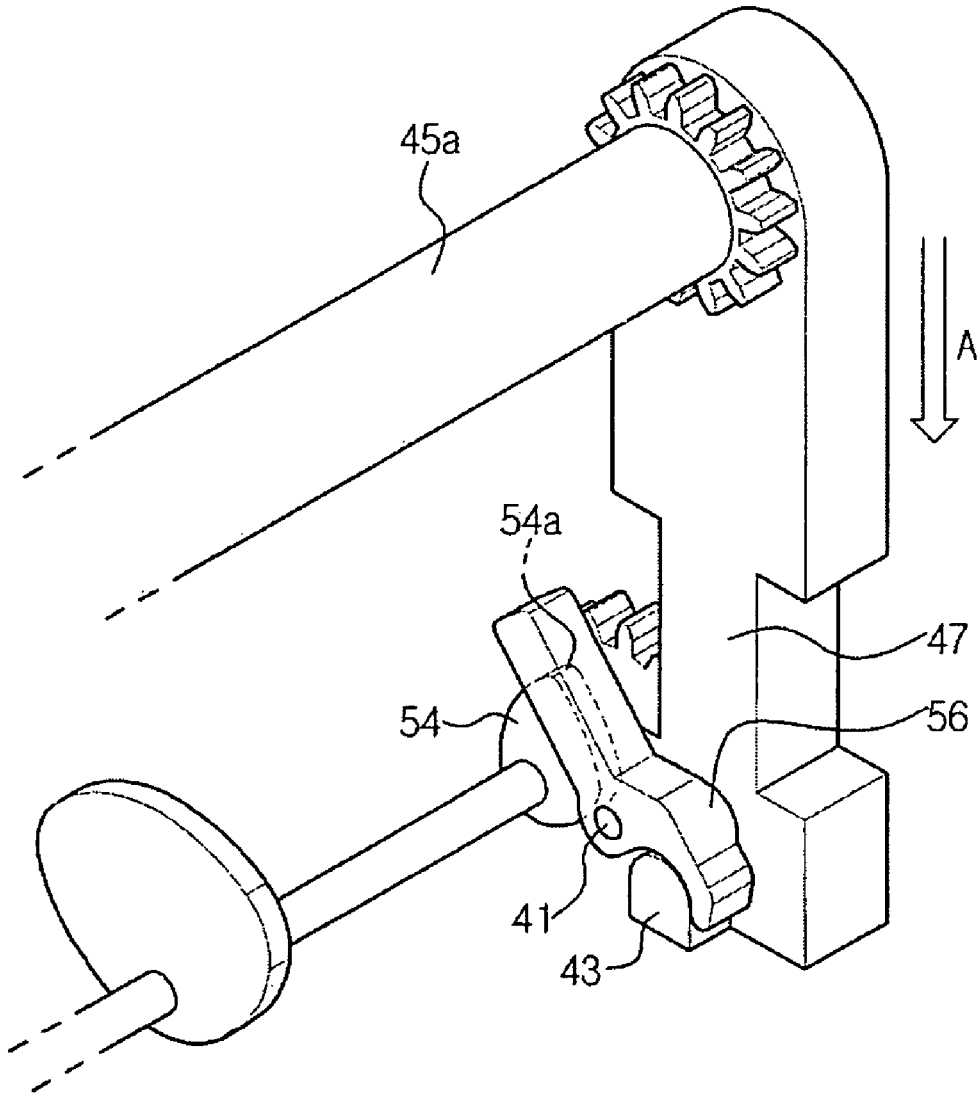
Figure 6:
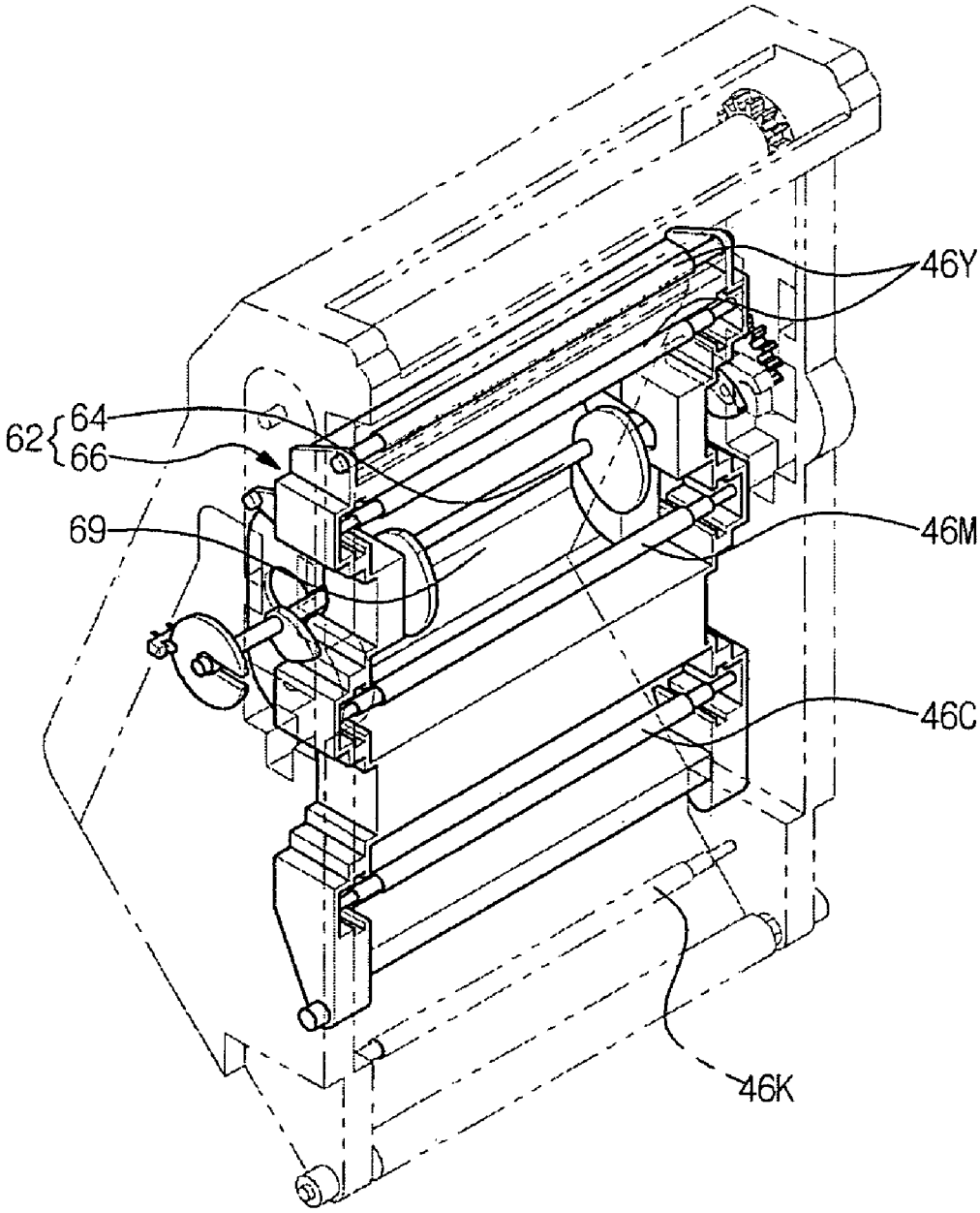
FIGS. 6 and 7 are views showing operation of a contact release device depicted in FIG. 2.
Figure 7:
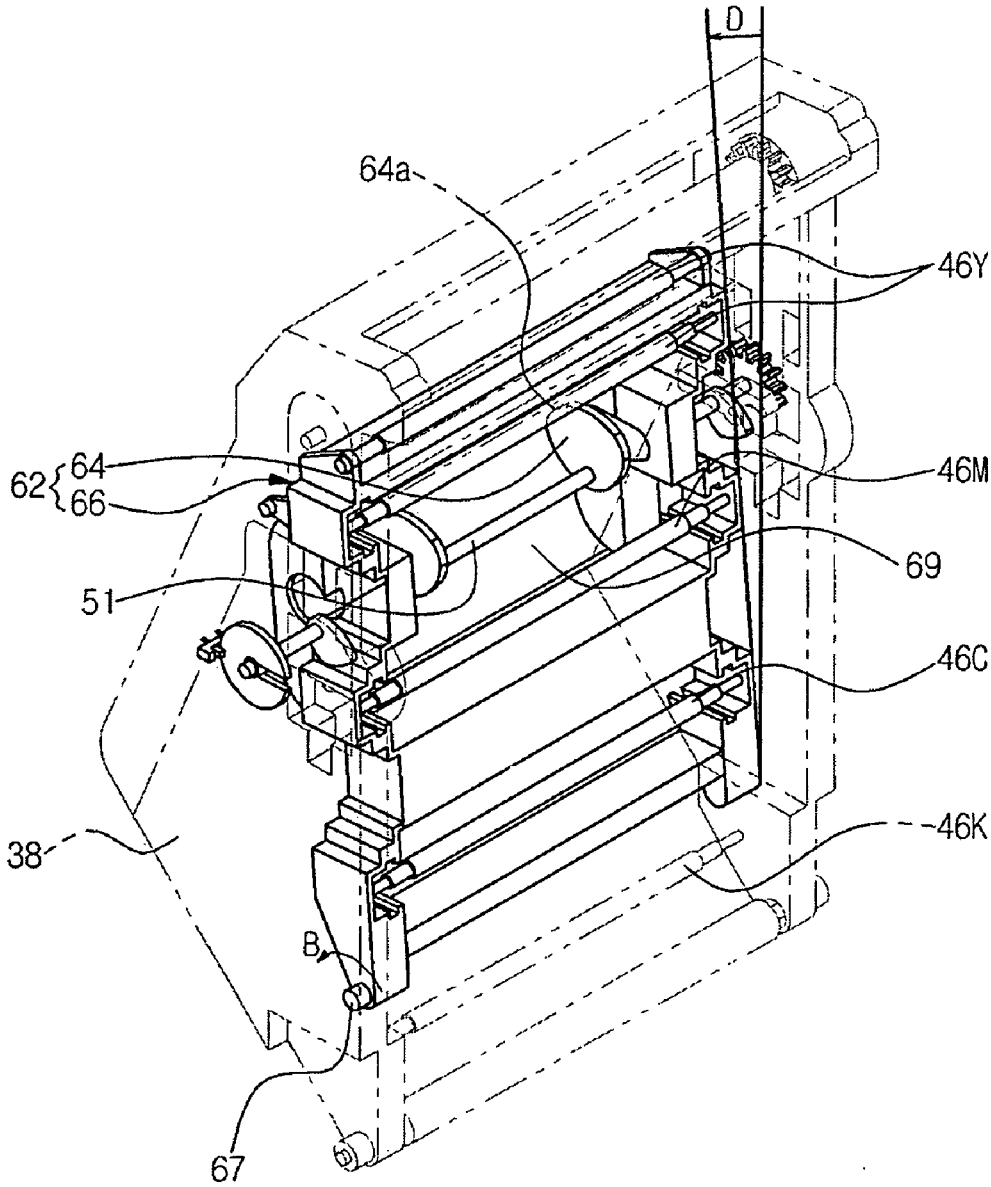

FIGS. 4 and 5 are views showing the operation of the tension release device depicted in FIG. 2, and FIGS. 6 and 7 are views showing the operation of the contact release device depicted in FIG. 2.

As shown in FIG. 4, when the tension release device 52 is in a non-operating state, the long axis end 54*a* of the first cam member 54 lies in a horizontal or front-to-back direction (i.e., not in a vertical or up-down direction). When the long axis end 54*a* lies in the front-to-back direction, the first intermediate transfer belt roller 45*a* is in a raised position by, e.g., elastic bias by an elastic member (not shown). When the first intermediate transfer belt roller 45*a* is in the raised position, the intermediate transfer belt 42 (refer to FIG. 2) is in a stretched state with certain level of tension.

As shown in FIG. 5, when the tension release device 52 operates, the long axis end 54*a* of the first cam member 54 extends upward (not in a front-to-back direction), and comes in contact with the lever 56, the first cam member 54 pushes up on one end of the lever 56. As a result of the pivoting of the lever 56 about the rotating shaft 41, the other end of the lever 56 moves downward to come into contact with, and to push down on, the latching protrusion 43. The downward movement of the latching protrusion 43 causes the extending part 47 and the first intermediate transfer belt roller 45*a* to move in a downward direction as indicated by the arrow (A). When the first intermediate transfer belt roller 45*a* moves down, the tension applied to the intermediate transfer belt 42 (refer to FIG. 2) is released. With the release of the tension, the pressing force exerted by first to third intermediate transfer belt rollers 45*a*, 45*b* and 45*c* (refer to FIG. 1) on the intermediate transfer belt 42 is reduced. Accordingly, even when the image forming apparatus remains in the stand-by mode for a prolonged time, during which the intermediate transfer belt 42 remains at a stationary position, owing to the reduction in the pressing force between the first to third intermediate transfer belt rollers 45*a*, 45*b* and 45*c* and the intermediate transfer belt 42, the likelihood of deformation of the intermediate transfer belt 42 may be reduced, which in turn may result in longer useful life of the intermediate transfer belt 42.

As shown in FIG. 6, in the color mode, the transfer roller receiving part 66 lies in the vertical direction while the long axis end(s) 64*a* of the second cam member(s) 64 does not contact, or at least does not press with sufficient force against, the contact surface 69 of the transfer roller receiving part 66 so that the transfer roller receiving part 66 remains in the vertical position by, e.g., an elastic bias from an elastic member (not shown). In such a state, all of the first transfer rollers 46Y, 46M, 46C and 46K may press the intermediate transfer belt 42 toward the respective image carriers 32Y, 32M, 32C and 32K (refer to FIG. 1).

As shown in FIG. 7, in the monochromatic mode, the long axis end 64*a* of the second cam member 64 is rotated to come into pressing contact with the contact surface 69 of the transfer roller receiving part 66. As a result, the transfer roller receiving part 66 rotates about the rotating shafts 67 in the rotational direction (B) by a rotational angle (D). With the transfer roller receiving part 66 so rotated, the yellow, magenta and cyan transfer rollers 46Y, 46M and 46C provided in the transfer roller receiving part 66 are separated from the intermediate transfer belt 42, and, as a result, the intermediate transfer belt 42 is separated from the yellow, magenta and cyan image carriers 32Y, 32M and 32C. However, as the black transfer roller 46K provided in the transfer device body 38 separate from the transfer roller receiving part 66, the black transfer roller 46K continues to press the intermediate transfer belt 42 to the black image carrier 32K, so as to realize the printing of a black and white image using the black developer. Accordingly, the likelihood of damages to the intermediate transfer belt 42 due to unnecessary frictional contact with the yellow, magenta and cyan image carriers 32Y, 32M and 32C may be reduced.

Hereinafter, the control signals to operate the tension release device and the contact release device according to an embodiment will be explained.

Figure 8:
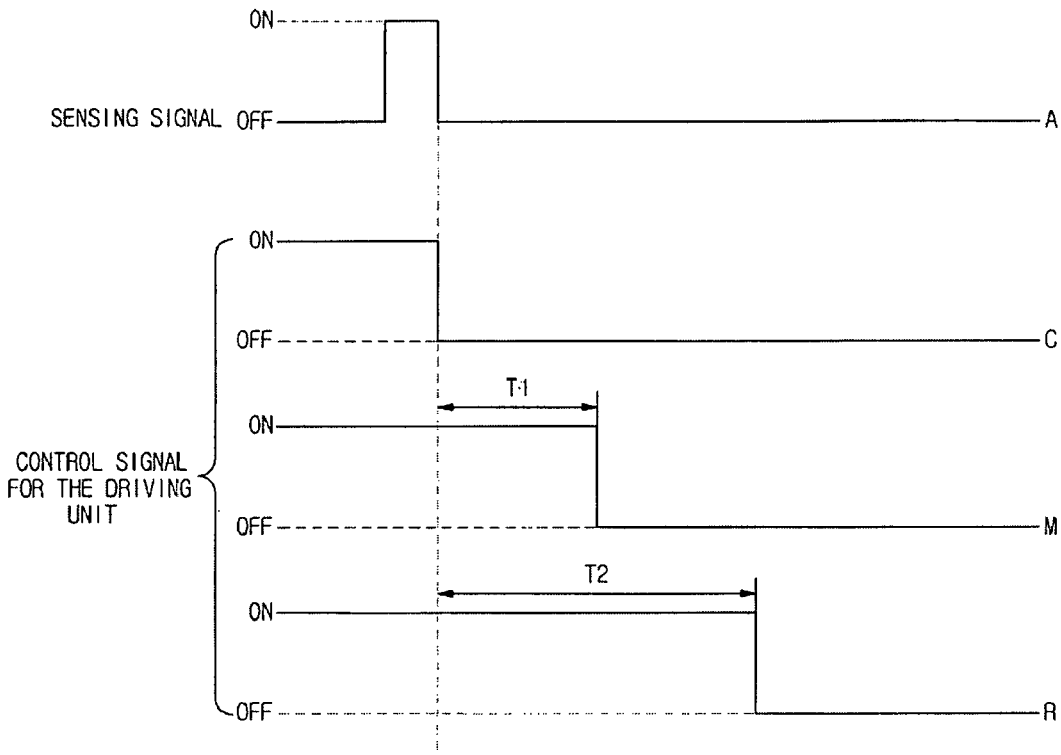
FIG. 8 is a timing diagram showing operation of the tension release device and the contact release device depicted in FIG. 2.

FIG. 8 is a timing diagram illustrative of an example of the operation of the tension release device and the contact release device depicted in FIG. 2.

As shown in FIG. 8, a degree of rotation of the rotating shaft 51 (refer to FIG. 3) is determined based on a sensing signal (A). An OFF state refers to a state in which the sensing signal (A) is not generated. During the rotation of the sensed part 58 (refer to FIG. 3) with the rotating shaft 51, when the position determination portion 57 of the sensed part 58 passes by the sensing part 59, the sensing signal (A) becomes an ON state. The ON state of the sensing signal (A) represents that the rotating shaft 51 is positioned at a specific angle. That is, this means that the first and second cam members 54 and 64 (refer to FIG. 3) coupled to the rotating shaft 51 are located at known positions.

When the image forming apparatus 10 (refer to FIG. 1) is in a color mode (C) to realize the printing of a color image, when the sensing signal (A) is in an ON state, the control signal for the driving unit (not shown) for driving the rotational shaft 51 is turned OFF. If the control signal for the driving unit is turned OFF, the operation of the driving unit is stopped at a position, in which the printing of a color image can be achieved. That is, as shown in FIG. 6, the long axis end 64*a* of the second cam member 64 lies in a direction other than the rearward extending direction. Therefore, the transfer roller receiving part 66 lies in a vertical direction, so that all of the first transfer rollers 46Y, 46M, 46C and 46K press the intermediate transfer belt 42 toward the respective image carriers 32Y, 32M, 32C and 32K, thereby allowing the printing of a color image.

When the image forming apparatus 10 is in the monochromatic mode (M) to realize the printing of a black and white image, the control signal for the driving unit is maintained in an ON state for a first predetermined time (T1) after the ON state of the sensing signal (A). Therefore, the driving unit further rotates the rotational shaft 51 for the first predetermined time (T1), and then stops driving after T1, at which stopped location the printing of a black and white image can be achieved. That is, as shown in FIG. 7, the long axis end 64*a* of the second cam member 64 is directed backward, and presses the contact surface 69, so that the transfer roller receiving part 66 is rotated on the rotating shafts 67. When the transfer roller receiving part 66 is rotated, the yellow, magenta and cyan transfer rollers 46Y, 46M and 46C provided in the transfer roller receiving part 66 are separated from the intermediate transfer belt 42, and only the black transfer roller 46K presses the intermediate transfer belt 42 to the black image carrier 32K. Accordingly, the yellow, magenta and cyan image carriers 32Y, 32M and 32C are separated from the intermediate transfer belt 42, and as a result the damage of the intermediate transfer belt 42 and/or the yellow, magenta and cyan image carriers 32Y, 32M and 32C due to friction therebetween may be mitigated.

When the image forming apparatus 10 is in a stand-by mode (R), i.e., in a non-operating mode, the control signal for the driving unit is maintained in an ON state for a second predetermined time (T2) after the ON state of the sensing signal (A). Therefore, the driving unit further rotates the rotational shaft 51 for the second predetermined time (T2), after which it stops. At such stopped position, as shown in FIG. 5, the long axis end 54*a* of the first cam member 54 extends upward to presses the contacting end of the lever 56 so that the first intermediate transfer belt roller 45*a* moves downward, which in turn releases the tension in the intermediate transfer belt 42, as a result, reducing the likelihood of deformation of the intermediate transfer belt 42.

Figure 9:
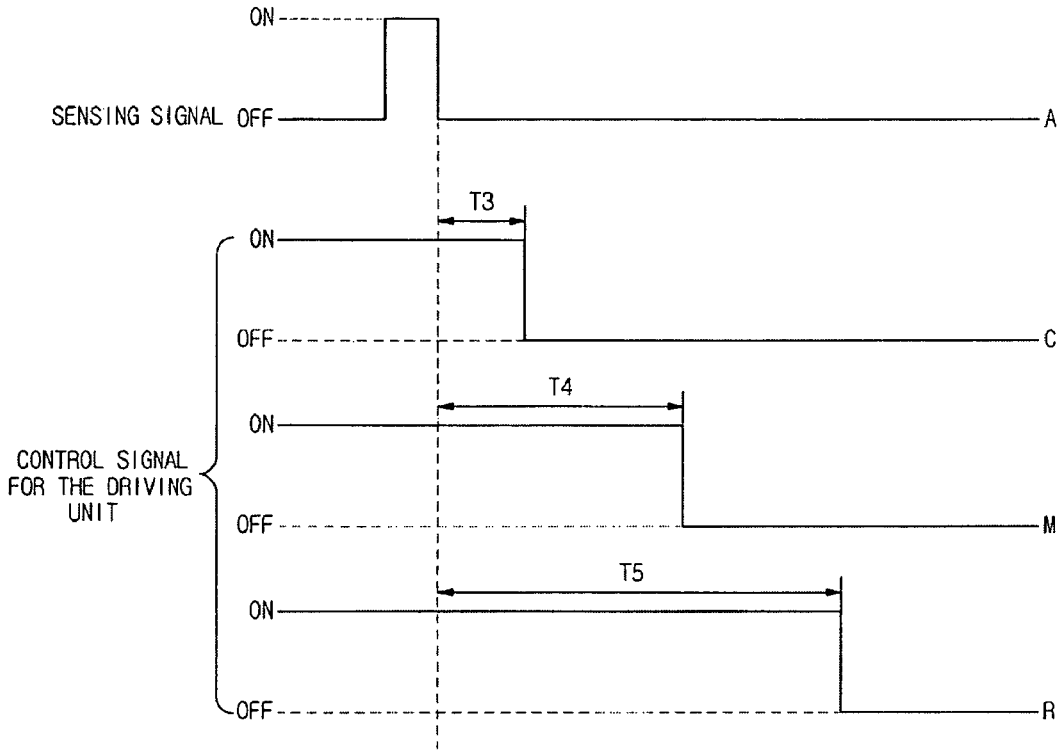
FIG. 9 is timing diagram showing operation of a tension release device and a contact release device according to another embodiment.

FIG. 9 is a timing diagram illustrative of another example of the operation of a tension release device and a contact release device according to an alternative embodiment of the present disclosure.

According to the embodiment illustrated in FIG. 9, after the sensing signal (A) is turned ON from OFF, if the control signal is maintained in an ON state for a third predetermined time (T3), the image forming apparatus 10 is placed in the color mode (C) to realize the printing of a color image.

After the sensing signal (A) is turned ON, if the control signal is maintained in an ON state for a fourth predetermined time (T4), the image forming apparatus 10 is placed in the monochromatic mode (M) to realize the printing of a black and white image.

After the sensing signal (A) is turned ON, if the control signal is maintained in an ON state for a fifth predetermined time (T5), the image forming apparatus 10 is placed in the stand-by mode (R), in which the tension applied to the intermediate transfer belt 42 (refer to FIG. 1) is removed.

As described above, the embodiment shown in FIG. 9 is different from the previously described embodiment of FIG. 8 in that the operating mode of the image forming apparatus 10 is placed in the color mode (C) after the rotating shaft 51 (refer to FIG. 3) is further rotated for the third predetermined time (T3) after the sensing signal (A) is turned ON.

Although for illustrative purposes it has been described that the above embodiments are described as being constituted such that the yellow developing assembly, the magenta developing assembly, the cyan developing assembly and the black developing assembly are arranged vertically in a particular sequence with respect to one another, the number and the arrangement of the developing assemblies should not be construed to be so limited.

Moreover, although it has been described in various embodiments above that only the black image carrier is operated in the monochromatic mode, it should be understood that the image carrier of any other color developer disposed at any other position may be operated in the monochromatic mode.

Further, although it has been described in various embodiments above that an image of only one color is printed in the monochromatic mode, it should be understood that the printing of images of two or more colors less than the all available developer colors may be employed in the monochromatic mode.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A transfer device, comprising:

an intermediate transfer belt;

a transfer device body;

an intermediate transfer belt roller disposed on the transfer device body and configured to provide tension in the intermediate transfer belt;

a transfer roller receiving part pivotably disposed on the transfer device body;

transfer rollers disposed in the transfer roller receiving part and configured to press the intermediate transfer belt toward corresponding ones of image carriers; and a state changing device disposed in the transfer roller receiving part and configured to move the intermediate transfer belt roller to reduce the tension in the intermediate transfer belt during a first operating state of the transfer device and to pivot the transfer roller receiving part to separate the transfer rollers from the intermediate transfer belt during a second operating state of the transfer device.

2. The transfer device according to claim 1, wherein:

the transfer device body comprises an extending part upon which the intermediate transfer belt roller is disposed; and the state changing device moves the extending part with respect to the transfer device body, to reduce the tension in the intermediate transfer belt.

3. The transfer device according to claim 1, wherein the state changing device comprises:

a rotating shaft;

a lever configured to move the intermediate transfer belt roller;

a first cam member coupled to the rotating shaft and configured to move the lever; and a second cam member coupled to the rotating shaft and configured to pivot the transfer roller receiving part.

4. The transfer device according to claim 1, further comprising a sensing unit to sense a current operating state of the transfer device.

5. The transfer device according to claim 4, wherein the sensing unit comprises:

a rotating shaft;

a sensed part coupled to the rotating shaft and having a position determination portion; and a sensing part configured to sense the position determination portion during a rotation of the rotating shaft and generate a corresponding control signal.

6. The transfer device according to claim 5, wherein:

the rotating shaft is further rotated after the sensing part generates the control signal, the amount of the further rotation being based on a time during which the rotating shaft is driven in relation to the control signal.

7. A transfer device, comprising:

an intermediate transfer belt disposed between image carriers and transfer rollers;

an intermediate transfer belt roller configured to apply tension to the intermediate transfer belt; and a state changing device comprising:

a rotating shaft;

a first cam member coupled to the rotating shaft and configured to move the intermediate transfer belt roller to reduce the tension applied to the intermediate transfer belt; and a second cam member coupled to the rotating shaft and configured to move at least one of the transfer rollers away from the intermediate transfer belt.

8. The transfer device according to claim 7, further comprising a sensing unit to sense a rotational position of the rotating shaft.

9. An image forming apparatus, comprising:

a main body;

image carriers supported in the main body;

an intermediate transfer belt arranged to contact one or more of the image carriers;

transfer rollers each configured to press the intermediate transfer belt toward a corresponding one of the image carriers;

intermediate transfer belt rollers configured to apply tension to the intermediate transfer belt;

a lever configured to move at least one of the intermediate transfer belt rollers away from the intermediate transfer belt;

a transfer roller receiving part to move at least one of the transfer rollers away from the intermediate transfer belt;

a rotating shaft;

a first cam member coupled to the rotating shaft and configured to move the lever; and a second cam member coupled to the rotating shaft and configured to move the transfer roller receiving part to separate at least one of the transfer rollers from a corresponding one the image carriers.

10. The image forming apparatus according to claim 9, further comprising:

a sensed part coupled to the rotating shaft, the sensed part having at least one position determination portion; and a sensing part to sense the position determination portion as the sensed part rotates about the rotating shaft, the sensing part being further configured to output a control signal upon sensing of the position determination portion.

11. An apparatus for controlling a transfer device of an image forming apparatus, the image forming apparatus being operable in at least first and second operational modes, the transfer device including an intermediate transfer belt to receive developer images from image carriers and transfer rollers configured to impart a pressing force on the intermediate transfer belt to maintain contact between the intermediate transfer belt and the image carriers, the transfer device further including intermediate transfer belt rollers configured to apply an operational level of tension to the intermediate transfer belt, the apparatus comprising:

a rotating shaft having a first rotational position corresponding to the first operational mode of the image forming apparatus and a second rotational position corresponding to the second operational mode of the image forming apparatus;

a first cam member coupled to the rotating shaft such that when the rotating shaft is in the first rotational position, the first cam member moves at least one of the intermediate transfer belt rollers away from the intermediate transfer belt and the intermediate transfer belt has less than the operational level of tension; and a second cam member coupled to the rotating shaft such that when the rotating shaft is in the second rotational position, the second cam member moves at least one of the transfer rollers away from the intermediate transfer belt such that the intermediate transfer belt and a corresponding one the image carriers are spaced apart from each other.

12. The apparatus according to claim 11, further comprising:

an intermediate transfer belt roller support member to support at least one of the intermediate transfer belt rollers and comprising a latching protrusion; and a lever configured to pivot to a first lever position when the rotating shaft is in the first rotational position and to a second lever position when the rotating shaft is in the second rotational position, wherein, when the lever is in the first lever position, a first end of the lever contacts the first cam member, while an opposing second end of the lever moves the latching protrusion such that the latching protrusion moves the intermediate transfer belt roller support member, and when the lever is in the second lever position, the lever exerts no pressing force on the latching protrusion.

13. The apparatus according to claim 12, further comprising:

a transfer roller support member configured to support at least one of the transfer rollers, wherein the second cam member, when the rotating shaft is in the second rotational position, being in pressing contact with the transfer roller support member so as to cause the transfer roller support member to pivot away from the intermediate transfer belt.

* * * * *